US006527652B1

(12) United States Patent
Maruko et al.

(10) Patent No.: US 6,527,652 B1
(45) Date of Patent: Mar. 4, 2003

(54) SOLID GOLF BALL

(75) Inventors: Takashi Maruko, Chichibu (JP); Hisashi Yamagishi, Chichibu (JP); Yutaka Masutani, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 52 days.

(21) Appl. No.: 09/618,160

(22) Filed: Jul. 17, 2000

Related U.S. Application Data

(60) Provisional application No. 60/150,552, filed on Aug. 25, 1999.

(30) Foreign Application Priority Data

Jul. 28, 1999 (JP) ..... 11-213478

(51) Int. Cl.[7] ..... A63B 37/06
(52) U.S. Cl. ..... 473/371; 473/376
(58) Field of Search ..... 473/376, 373, 473/374, 377, 378, 367, 368, 371

(56) References Cited

U.S. PATENT DOCUMENTS 5,730,665 A * 3/1998 Shimosaka et al. ..... 473/376
5,816,937 A * 10/1998 Shimosaka et al. ..... 473/354
5,919,100 A * 7/1999 Boehm et al. ..... 473/354
6,068,561 A * 5/2000 Renard et al. ..... 473/364
6,117,025 A * 9/2000 Sullivan ..... 473/373
6,159,110 A * 12/2000 Sullivan et al. ..... 473/374
6,162,134 A * 12/2000 Sullivan et al. ..... 473/373
6,204,331 B1 * 3/2001 Sullivan et al. ..... 473/372
6,302,808 B1 * 10/2001 Dalton et al. ..... 473/371

FOREIGN PATENT DOCUMENTS

JP 8-336617 12/1996 ..... A63B/37/00
JP 8-336618 12/1996 ..... A63B/37/00
JP 9-56848 3/1997 ..... A63B/37/00
JP 9-299510 11/1997 ..... A63B/37/00
JP 11-417 1/1999 ..... A63B/37/04
JP 11-4916 1/1999 ..... A63B/37/12

* cited by examiner

*Primary Examiner*—Mark S. Graham
*Assistant Examiner*—Raeann Gorden
(74) *Attorney, Agent, or Firm*—Sughrue Mion, PLLC

(57) ABSTRACT

A multilayer solid golf ball comprising a core and a cover of four layers is characterized in that the core undergoes a deflection of 2.5–5.5 mm under an applied load of 100 kg, the difference in hardness between a first layer of the cover enclosing the core and a second layer of the cover enclosing the first layer is at least 5 Shore D hardness units, the second layer has a Shore D hardness of up to 52, a third layer of the cover enclosing the second layer is harder than the second layer and a fourth layer of the cover enclosing the third layer.

6 Claims, 1 Drawing Sheet

SOLID GOLF BALL

CROSS REFERENCE TO RELATED APPLICATION

This application is an application filed under 35 U.S.C. §111(a) claiming benefit pursuant to 35 U.S.C §119(e)(i) of the filing date of the Provisional Application No. 60/150,552 filed on Aug. 25, 1999 pursuant to 35 U.S.C. §111(b).

BACKGROUND OF THE INVENTION

1. Field of the Invention

This invention relates to a multilayer structure solid golf ball comprising a core and a cover of at least four layers formed therearound.

2. Prior Art

The solid golf ball structures which have heretofore been proposed include multilayer structure solid golf balls comprising a core and a cover which are of multiple layers (see JP-A 8-336617, 8-336618, 9-56848, 9-299510, 11-417, and 11-4916).

One of the purposes of increasing the number of layers in solid golf balls is to obtain a feel equivalent to that of wound golf balls and another is to increase flight distance. In most cases, however, it often occurs that a preference for the feel leads to an unsatisfactory flight distance whereas the satisfaction of flight distance leads to a poor feel. Also, most prior art proposals mainly target golf players with a high head speed capability. Thus, there is a desire to have a golf ball which offers a satisfactory flight distance and a pleasant feel even when hit at low head speeds.

SUMMARY OF THE INVENTION

An object of the present invention is to provide a multilayer solid golf ball which offers a satisfactory flight distance and a pleasant feel not only when hit at high head speeds, but also when hit at low head speeds.

To achieve this and other objects, the present invention provides a golf ball as defined below.

(1) A multilayer solid golf ball comprising a core and a cover of four layers, characterized in that the core undergoes a deflection of 2.5 to 5.5 mm under an applied load of 100 kg, the difference in hardness between a first layer of the cover enclosing the core and a second layer of the cover enclosing the first layer is at least 5 Shore D hardness units, the second layer has a Shore D hardness of up to 52, a third layer of the cover enclosing the second layer is harder than the second layer and a fourth layer of the cover enclosing the third layer.

(2) The solid golf ball of (1) wherein the core has a diameter of 26 to 35 mm, the core at its surface has a Shore D hardness of at least 40, and the fourth layer of the cover has a thickness of 0.5 to 3.0 mm.

(3) The solid golf ball of (1) or (2) wherein the second layer of the cover is formed of at least one member selected from the group consisting of polyester resins, polyurethane resins, and thermoplastic polyamide elastomers.

Making extensive investigations in the light of the above object, the inventor has found that by forming a cover from the above-described four layers, a difference in hardness can be established between the intermediate layers of the cover. The core selected to the above range of deflection or hardness cooperates with the first to third layer of the cover in such a manner as to improve resilience and feel, and the fourth layer of the cover improves spin properties.

DETAILED DESCRIPTION OF THE INVENTION

Figure 1:
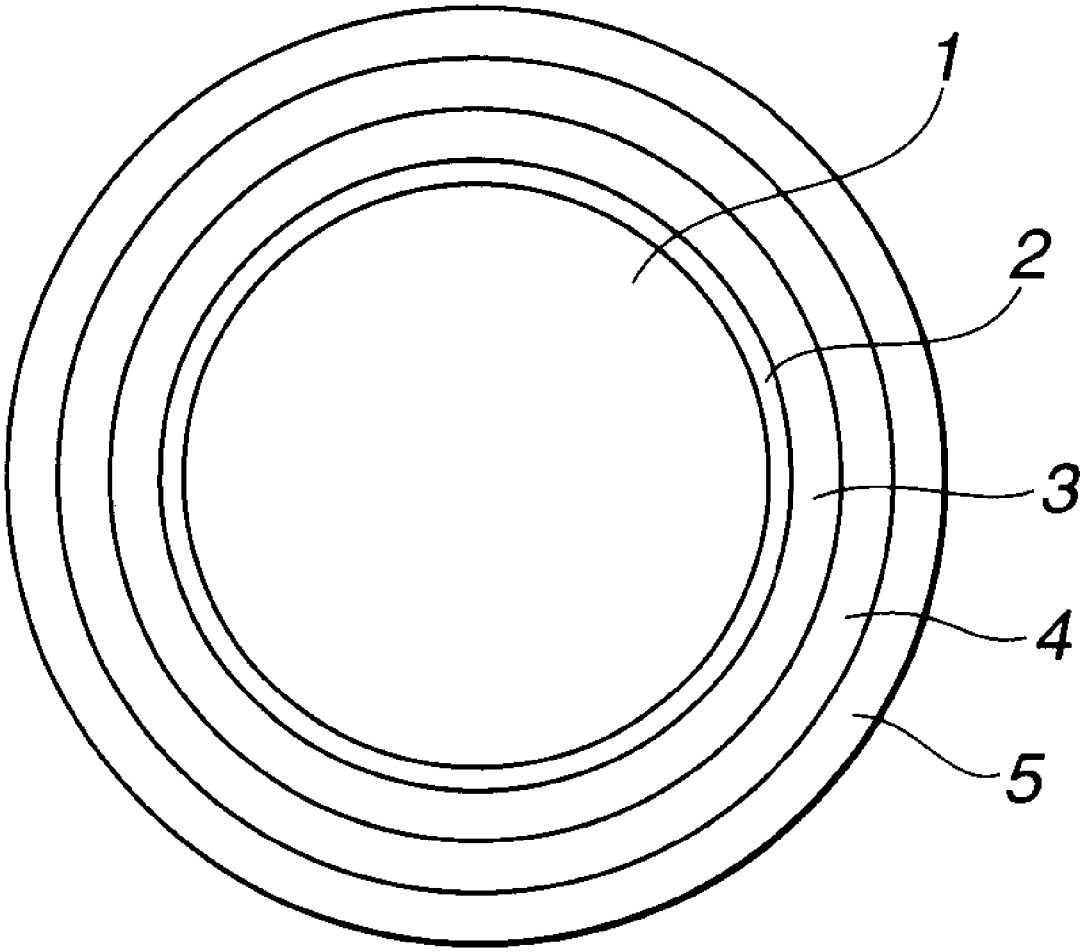
FIG. 1 is a cross-sectional view of one embodiment of the invention.

The golf ball of the invention has a core of at least one layer and a cover of four layers. As shown in FIG. 1, a first layer 2 of the cover is formed around a core 1, and a second layer 3, a third layer 4, and a fourth layer 5 of the cover are successively formed so as to enclose the preceding layer.

The core may be formed to a diameter of at least 26 mm, especially at least 29 mm and up to 35 mm, especially up to 33.5 mm.

The core may be formed of a rubber composition, a thermoplastic resin or a mixture thereof. The rubber composition used herein may be any well-known composition although a composition using polybutadiene as the base is preferable. As the polybutadiene, 1,4-cis polybutadiene containing at least 40% of cis-structure is preferably used. In the base rubber, natural rubber, polyisoprene rubber or styrene-butadiene rubber may be properly blended with the polybutadiene if desired. The golf ball can be improved in resilience by increasing the content of rubber component.

In the rubber composition, there may be blended a crosslinking agent, for example, zinc and magnesium salts of unsaturated fatty acids such as zinc methacrylate and zinc diacrylate, and esters such as trimethylpropane methacrylate. Of these, zinc diacrylate is preferably used. An appropriate amount of the crosslinking agent blended is 10 to 40 parts by weight per 100 parts by weight of the base rubber.

In the rubber composition, a vulcanizing agent is usually blended. Peroxides, typically organic peroxides are preferred vulcanizing agents. Such peroxides are commercially available, for example, as Percumyl D and Perhexa 3M from Nippon Oil and Fats K.K. The amount of the vulcanizing agent blended may be 0.6 to 2 parts by weight per 100 parts by weight of the base rubber.

Moreover, an antioxidant and a filler for specific gravity adjustment such as zinc oxide or barium sulfate are blended if necessary.

Preferably the core at its surface has a Shore D hardness of at least 40, more preferably at least 45, most preferably at least 49, and up to 65, more preferably up to 63.

The core used herein may be formed to a multilayer structure of at least two layers. In one exemplary construction, the innermost core is formed of a rubber composition and an outer core is formed around the innermost core from a thermoplastic resin such as an ionomer resin. The outer core has a Shore D hardness in the above range.

The core should undergo a deflection or deformation of at least 2.5 mm, especially at least 2.8 mm and up to 5.5 mm, especially up to 5.2 mm, when a load of 100 kg is applied thereto. A too small deflection leads to a lowering of feel whereas a too large deflection leads to a loss of resilience.

Preferably the first to fourth layers of the cover each are individually formed of thermoplastic resins although they may also be formed of rubber base materials. Exemplary thermoplastic resins include polyurethane resins (thermoplastic polyurethane elastomers), polyester resins (thermoplastic polyester elastomers), thermoplastic polyamide elastomers, and ionomer resins. Commercially available products are Pandex (thermoplastic polyurethane elastomers by Dai-Nippon Ink and Chemicals K. K.), Hytrel (thermoplastic polyester elastomers by Toray-Dupont K. K.), Surlyn (ionomer resins by Dupont), Himilan (ionomer resins by Mitsui-Dupont Polychemical K. K.), Rilsan (polyamide resins by Elf Atochem), and Pebax (thermoplastic polyamide elastomers by Elf Atochem).

According to the invention, the difference in hardness between the first and second layers of the cover is at least 5 Shore D hardness units, preferably at least 7 Shore D hardness units, more preferably at least 10 Shore D hardness units. Such a hardness difference is effective for improving resilience and feel. The upper limit of the hardness difference is preferably up to 45, especially up to 30.

Herein, either one of the first and second layers of the cover may be harder than the other. If the cover first layer is harder, there results the advantage of high resilience because the soft second layer is sandwiched between the hard first and third layer of the cover. If the cover second layer is harder, there results the advantage of good feel because the hardness change among the first to third layers becomes smooth.

The cover second layer is preferably formed to a Shore D hardness of at least 20, more preferably at least 25 and up to 52, more preferably up to 50, most preferably up to 47. The cover second layer is preferably formed of a polyester resin, polyurethane resin, thermoplastic polyamide elastomer or a mixture thereof. An ionomer resin may be admixed therewith if desired. The hardness of the cover first layer is properly selected in consideration of the hardness of the cover second layer and the hardness difference therefrom.

The cover first layer preferably has a thickness of at least 0.5 mm, more preferably at least 0.8 mm and most preferably at least 1.0 mm and up to 4.0 mm, more preferably up to 3.0 mm, and most preferably up to 2.5 mm.

Similarly, the cover second layer preferably has a thickness of at least 0.5 mm, more preferably at least 0.8 mm and most preferably at least 1.0 mm and up to 4.0 mm, more preferably up to 3.0 mm, and most preferably up to 2.5 mm.

The cover third layer is preferably formed to a Shore D hardness of at least 55, especially at least 58, and up to 70, especially up to 68. To achieve the object of the invention, the cover third layer should be made harder than the cover second layer and the cover fourth layer to be described later. The cover third layer is preferably formed of an ionomer resin.

The cover third layer preferably has a thickness of at least 0.5 mm, more preferably at least 0.8 mm and most preferably at least 1.0 mm and up to 4.0 mm, more preferably up to 3.0 mm, and most preferably up to 2.5 mm.

The cover fourth layer should be made softer than the cover third layer. If the fourth layer is harder than the third layer, the object of the invention is not attainable. Preferably, the cover fourth layer has a Shore D hardness of at least 40, more preferably at least 45, and up to 55, more preferably up to 53. The difference in hardness between the third and fourth layers is preferably at least 5, especially at least 8.

The material of which the cover fourth layer is formed is not critical although it may be formed of polyurethane resins as well as ionomer resins.

The cover fourth layer preferably has a thickness of at least 0.5 mm, more preferably at least 0.8 mm, most preferably at least 1.0 mm and up to 3.0 mm, more preferably up to 2.5 mm.

Understandably, the first to fourth layers of the cover are preferably formed of thermoplastic resins as previously described while it is optional to blend inorganic fillers therein for the purpose of specific gravity adjustment and add other suitable additives thereto.

Like conventional golf balls, the golf ball of the invention may be formed with 300 to 600 dimples in a well-known arrangement.

Understandably, the diameter and weight of the golf ball of the invention comply with the Rules of Golf. The ball may be formed to a diameter of not less than 42.67 mm, and especially from 42.67 mm to 42.75 mm and a weight of not greater than 45.93 g, and especially from 45.90 g to 45.10 g.

The golf ball of the invention offers a satisfactory flight distance performance regardless of whether the head speed is high or low and especially, achieves a flight distance improvement and a pleasant feel even when hit at low head speeds.

EXAMPLE

Examples and Comparative Examples are given below for illustrating the invention although the invention is not limited to the Examples.

Examples & Comparative Examples

Using the rubber formulation shown in Table 1 and the resin blend shown in Table 2, five-piece solid golf balls were prepared as shown in Table 3 and examined for flight performance and feel by the following methods. The results are shown in Table 3.

Flight Performance

Using a swing robot, the ball was hit with a driver at a head speed of 50 m/sec and 40 m/sec. An initial velocity, carry and total distance were measured.

Feel

Three professional golfers actually hit the ball for evaluation. ◎: very good ○: good Δ: ordinary x: poor

TABLE 1

| Rubber composition (pbw) | Rubber A | Rubber B | Rubber C | Rubber D | Rubber E | Rubber F | Rubber G | Rubber H | Rubber I | Rubber J |
|---|---|---|---|---|---|---|---|---|---|---|
| JSR BR01 | 100.0 | 100.0 | 100.0 | 100.0 | 100.0 | 100.0 | 100.0 | 100.0 | 100.0 | 100.0 |
| Zinc diacrylate | 30.0 | 35.0 | 25.0 | 25.0 | 35.0 | 10.0 | 20.0 | 28.8 | 28.0 | 23.0 |
| Zinc oxide | 35.7 | 25.2 | 44.3 | 12.7 | 73.0 | 30.0 | 6.0 | 5.0 | 5.0 | 6.0 |
| Zinc stearate | | | | | | | 15.0 | | | 15.0 |
| Barium sulfate | | | | | | | | 43.8 | | |
| Nocrack NS-6 | 0.2 | 0.2 | 0.2 | 0.2 | 0.2 | 0.5 | | 0.2 | 0.5 | |
| Dicumyl peroxide | 1.0 | 1.0 | 1.0 | 1.0 | 1.0 | 1.5 | 0.9 | 1.2 | 1.5 | 0.9 |
| Tungsten | | | | | | | 114.0 | | | |

* Vulcanizing Conditions
core: 155° C., 15 min
inner and intermediate layers: 130° C., 10 min (semi-vulcanization) →155° C., 15 min (full vulcanization)

TABLE 2

| Resin composition (pbw) | Resin A Ionomer | Resin B Ionomer | Resin C Ionomer | Resin D Ionomer | Resin E Ionomer | Resin F Ionomer | Resin G Polyester | Resin H Polyester | Resin I Polyester | Resin J Poly-urethane | Resin K Poly-urethane | Resin L Polyamide elastomer |
|---|---|---|---|---|---|---|---|---|---|---|---|---|
| Himilan AM7315 | | | | | 50 | | | | | | | |
| Himilan AM7318 | | | | | 50 | | | | | | | |
| Himilan 1605 | 50 | 50 | 50 | | | | | | | | | 30 |
| Himilan 1706 | | 50 | | | | | | | | | | |
| Himilan 1557 | | | | 30 | | | | | | | | |
| Himilan 1554 | 50 | | | | | | | | | | | |
| Surlyn 7930 | | | | | | 100 | | | | | | |
| Surlyn 8120 | | | 50 | 70 | | | | | | | | |
| Hytrel 3078 | | | | | | | 100 | | | | | |
| Hytrel 4047 | | | | | | | | 100 | | | | |
| Hytrel 4767 | | | | | | | | | 100 | | | |
| Pandex T-7298 | | | | | | | | | | | 70 | |
| Pandex T-7890 | | | | | | | | | | 100 | 30 | |
| Pebax 2533 | | | | | | | | | | | | 70 |
| Tungsten | | | | | | 20 | | | | | | |

TABLE 3

| | Example | | | | | Comparative Example | | |
|---|---|---|---|---|---|---|---|---|
| | 1 | 2 | 3 | 4 | 5 | 1 | 2 | 3 |
| Core | | | | | | | | |
| Material | Rubber A | Rubber B | Rubber C | Rubber D | Rubber E | Rubber F | Rubber G | Rubber H |
| Diameter (mm) | 32.7 | 30.7 | 29.2 | 30.7 | 26.7 | 25.0 | 35.1 | 31.7 |
| Weight (g) | 23.1 | 18.3 | 16.9 | 16.8 | 14.7 | 9.9 | 27.6 | 21.2 |
| Shore D at surface | 49 | 56 | 62 | 56 | 62 | 31 | 49 | 35 |
| Cover 1st layer | | | | | | | | |
| Material | Resin A | Resin H | Resin B | Resin E | Resin B | Rubber I | Rubber J | Resin G |
| Diameter* (mm) | 34.7 | 34.7 | 31.2 | 33.7 | 31.2 | 36.6 | 37.3 | 35.7 |
| Weight (g) | 26.5 | 25.9 | 19.7 | 21.6 | 21.1 | 29.1 | 32.0 | 28.9 |
| Shore D | 58 | 40 | 65 | 68 | 30 | 53 | 47 | 30 |
| Cover 2nd layer | | | | | | | | |
| Material | Resin G | Resin I | Resin H | Resin J | Resin L | Resin F | Resin E | Resin B |
| Diameter* (mm) | 36.7 | 36.7 | 34.7 | 34.7 | 34.7 | 36.5 | 39.9 | 38.7 |
| Weight (g) | 30.1 | 29.8 | 25.4 | 25.0 | 25.7 | 30.2 | 37.9 | 35.2 |
| Shore D | 30 | 47 | 40 | 50 | 41 | 68 | 68 | 65 |
| Cover 3rd layer | | | | | | | | |
| Material | Resin B | Resin A | Resin E | Resin E | Resin B | — | — | — |
| Diameter* (mm) | 38.7 | 39.7 | 39.7 | 38.7 | 38.7 | — | — | — |
| Weight (g) | 35.2 | 37.5 | 37.6 | 32.9 | 35.2 | — | — | — |
| Shore D | 65 | 58 | 68 | 68 | 65 | — | — | — |
| Cover 4th layer | | | | | | | | |
| Material | Resin C | Resin C | Resin D | Resin K | Resin C | Resin A | Resin D | Resin C |
| Diameter* (mm) | 42.7 | 42.7 | 42.7 | 42.7 | 42.7 | 42.7 | 42.7 | 42.7 |
| Weight (g) | 45.3 | 45.3 | 45.3 | 45.4 | 45.3 | 45.2 | 45.2 | 45.3 |
| Shore D | 53 | 53 | 47 | 41 | 53 | 58 | 47 | 53 |
| Flight performance HS 50 m/s W#1 | | | | | | | | |
| Initial velocity | 72.7 | 72.8 | 72.6 | 72.6 | 72.5 | 72.5 | 72.5 | 72.5 |

TABLE 3-continued

| | Example | | | | | Comparative Example | | |
|---|---|---|---|---|---|---|---|---|
| | 1 | 2 | 3 | 4 | 5 | 1 | 2 | 3 |
| (m/sec) | | | | | | | | |
| Carry (m) | 233.9 | 234.6 | 235.6 | 235.8 | 235.3 | 233.2 | 234.3 | 233.8 |
| Total (m) | 255.0 | 255.7 | 253.7 | 254.0 | 253.5 | 252.5 | 252.7 | 253.1 |
| Flight performance HS 40 m/s W#1 | | | | | | | | |
| Initial velocity (m/sec) | 58.8 | 58.6 | 58.6 | 58.5 | 58.5 | 58.5 | 58.5 | 58.5 |
| Carry (m) | 177.5 | 178.2 | 178.6 | 177.7 | 175.4 | 174.1 | 173.4 | 175.1 |
| Total (m) | 195.6 | 195.3 | 194.8 | 194.0 | 193.7 | 191.6 | 191.9 | 192.4 |
| Feel | ◎ | ○ | ◎ | ◎ | ○ | x | x | Δ |

*the diameter of the relevant cover layer formed around the core

What is claimed is:

1. A multilayer solid golf ball comprising a core and a cover of four layers, characterized in that the core undergoes a deflection of 2.5 to 5.5 mm under an applied load of 100 kg, the difference in hardness between a first layer of the cover enclosing the core and a second layer of the cover enclosing the first layer is at least 5 Shore D hardness units, the second layer has a Shore D hardness of up to 52, a third layer of the cover enclosing the second layer is harder than the second layer and a fourth layer of the cover enclosing the third layer, and the second layer of the cover is softer than the first layer of the cover.

2. The solid golf ball of claim 1 wherein the core has a diameter of 26 to 35 mm, the core at its surface has a Shore D hardness of at least 40, and the fourth layer of the cover has a thickness of 0.5 to 3.0 mm.

3. The solid golf ball of claim 1 wherein the second layer of the cover is formed of at least one member selected from the group consisting of polyester resins, polyurethane resins, and thermoplastic polyamide elastomers.

4. The multilayer solid golf ball of claim 1 wherein the forth layer of the cover is formed of polyurethane resins.

5. The multilayer solid golf ball of claim 1 wherein the second layer of the cover has a Shore D hardness of up to 47.

6. The multilayer solid golf ball of claim 1 wherein at least one of a first layer, a second layer and a third layer of the covers is formed of thermoplastic resin.

* * * * *